US006206598B1

(12) United States Patent
Johnson et al.

(10) Patent No.: US 6,206,598 B1
(45) Date of Patent: Mar. 27, 2001

(54) CAPPING DEVICE

(76) Inventors: Samuel V. Johnson, 324 W. Parkwood Rd., Decatur, GA (US) 30030-2823; Neil Sidell, 316 W. Parkwood Rd., Decatur, GA (US) 30030

( * ) Notice: Subject to any disclaimer, the term of this patent is extended or adjusted under 35 U.S.C. 154(b) by 0 days.

(21) Appl. No.: 09/406,221

(22) Filed: Sep. 27, 1999

(51) Int. Cl.[7] ..... B43K 7/02
(52) U.S. Cl. ..... 401/117; 401/107
(58) Field of Search ..... 604/192, 197, 604/198, 263; 401/99, 117, 107, 108, 131

(56) References Cited

U.S. PATENT DOCUMENTS

| | | | | |
|---|---|---|---|---|
| D. 312,658 | | 12/1990 | Sumino . | |
| D. 319,662 | | 9/1991 | Henry . | |
| D. 326,682 | | 6/1992 | Kimura . | |
| D. 368,490 | | 4/1996 | Melnick . | |
| 1,494,443 | | 5/1924 | Pollak . | |
| 1,615,506 | | 1/1927 | Felt . | |
| 1,859,775 | | 5/1932 | Hyams . | |
| 1,969,027 | | 8/1934 | Morrison . | |
| 4,518,273 | | 5/1985 | Larizza . | |
| 4,759,650 | | 7/1988 | Granoff . | |
| 4,988,227 | * | 1/1991 | Imazu | 401/117 |
| 5,232,457 | * | 8/1993 | Grim | 604/195 |
| 5,273,540 | * | 12/1993 | Luther et al. | 604/110 |
| 5,352,053 | | 10/1994 | Reitze . | |
| 5,590,971 | | 1/1997 | Melnick . | |
| 5,591,138 | * | 1/1997 | Vaillancourt | 604/263 |
| 5,632,565 | | 5/1997 | Yamaguchi . | |
| 5,720,732 | * | 2/1998 | Whisson | 604/198 |

FOREIGN PATENT DOCUMENTS

| | | |
|---|---|---|
| 2 221 872 | 2/1990 | (GB) . |
| WO 82/000614 | 3/1982 | (WO) . |

* cited by examiner

*Primary Examiner*—Gregory L. Huson
*Assistant Examiner*—Peter DeVore
(74) *Attorney, Agent, or Firm*—Schmeiser, Olsen & Watts

(57) ABSTRACT

A device for capping an object. The capping device includes a cap within a housing. An actuating apparatus moves an object from a first location outside the housing into a second location within the cap. The second location is offset from the first location. The object may include a writing element, a straw for drinking, a hypodermic needle, etc.

20 Claims, 5 Drawing Sheets

CAPPING DEVICE

FIELD OF THE INVENTION

The present invention relates generally to capping devices for covering and sealing an end of an object. The object may include a dispensing and/or suction device.

BACKGROUND OF THE INVENTION

Dispensing and/or suction devices commonly include a capping device for covering and sealing an end of a dispensing and/or suction element. Related art may include caps for writing instruments such as pens, covers applied to straws for drinking a liquid, caps for needles, etc. Generally, the caps are not attached to the dispensing and/or suction device and can be easily misplaced. For example, when a cap for a felt tip pen is lost, the fluid supplied to the writing tip evaporates and the tip becomes dry and may no longer write. When a removable cap is missing from a hypodermic needle, the exposed needle can puncture a person other than the user, and may result in the spread of an infectious disease. A loose cap may also present a danger to a child if the child swallows the cap. The cap may block the air passage of the child and cause breathing difficulties.

SUMMARY OF THE INVENTION

In order to overcome the above deficiencies, the present invention provides a capping device for covering the end of an object. The object may be a dispensing and/or suction device. The capping device includes a cap that is an internal integral part of a housing of the capping device.

The present invention generally provides a capping device comprising:

a housing;

a cap attached within the housing for covering an end of an object;

an actuating apparatus for moving the object from a first location outside the housing to a second location within the cap, wherein the cap is offset from the first location.

The present invention generally provides a method for capping comprising:

providing a cap within a housing;

retracting an end of the object from a first location to a second location within the housing;

rotating the end of the object into a position for capping; and extending the end of the object into the cap. The present invention provides a method comprising:

providing a cap within a housing;

retracting an end of the object from a first location outside the housing to a second location within the housing;

tilting the end of the object to a position for capping; and extending the end of the object into the cap.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
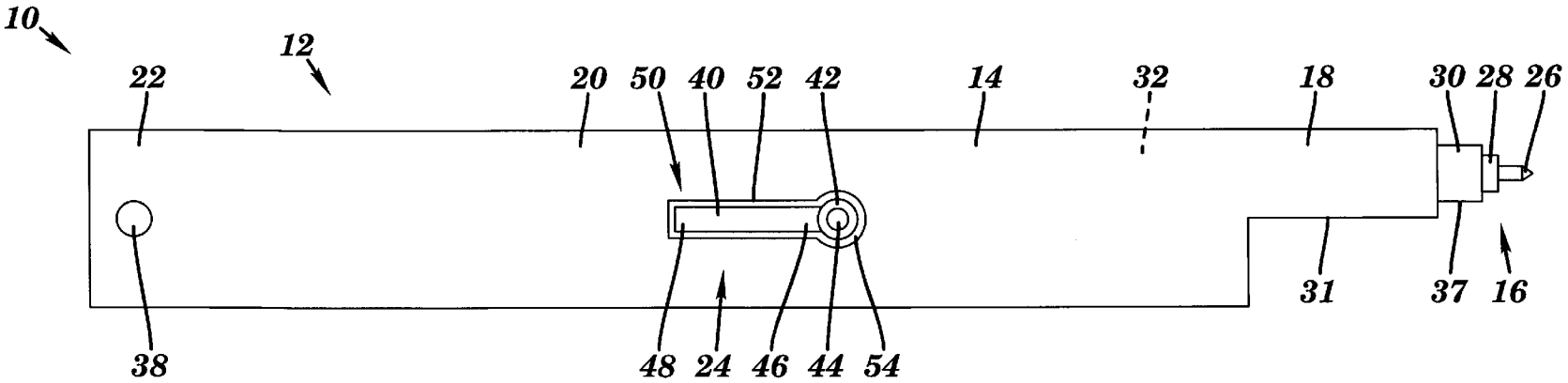
FIG. 1 illustrates a side view of a main body of a capping device according to the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

Figure 4:
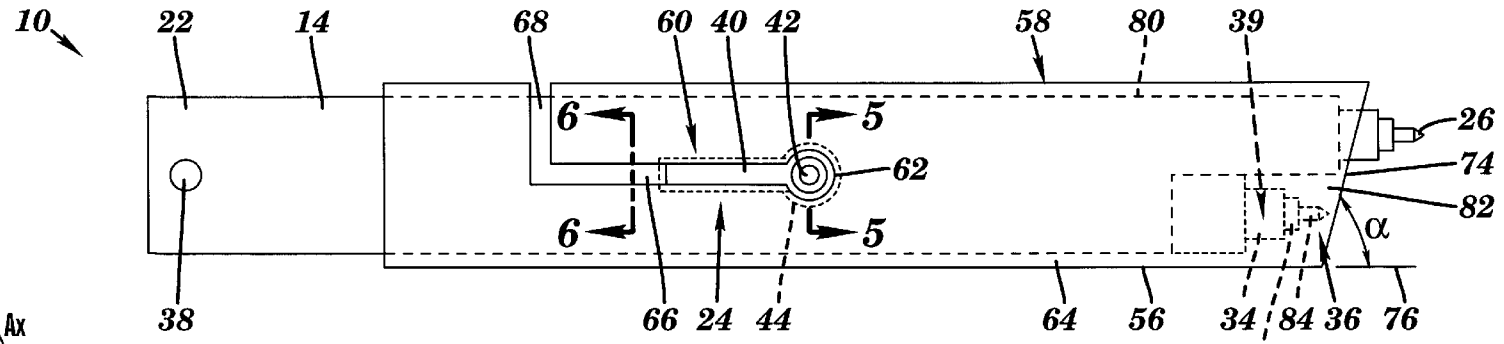
FIG. 4 illustrates a side view of a writing element extended beyond a housing.

FIG. 1 illustrates a side view of an object 12 to be capped using the capping device 10 according to the present invention. The capping device 10 includes a main body 14 of the object 12 to be capped and a housing 58. The main body 14 of the object 12 to be capped includes a writing apparatus 16, an end portion 18, a main portion 20, a tail portion 22, and an actuating apparatus 24. The writing apparatus 16 includes a writing element 26, a support body 28, and a sealing body 30. The writing element 26 may include any suitable writing element, e.g., a felt tip, an ink tip, a ball point pen, a dry marker tip, a fountain pen tip, etc. The writing element 26 may be connected to and supplied with material from a reservoir 32 within the main body 14. The writing element 26 is connected to the support body 28, which is connected to the sealing body 30. The sealing body 30 is connected to the end portion 18 of the main body 14. The support body 28 supports the writing element 26. The sealing body 30 is preferably substantially cylindrical in shape and provides an air tight seal when received in a sealing surface 34 of a cap 36 (FIG. 4). The substantially cylindrical sealing body 30 may include a taper with the smaller diameter end 37 being located closest to the support body 28.

Figure 3:
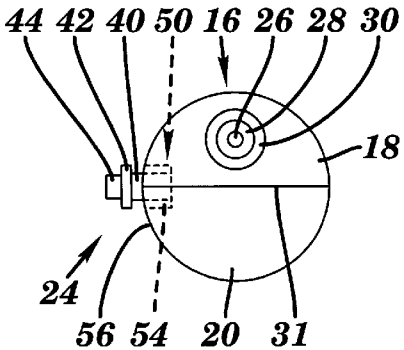
FIG. 3 illustrates a front view of the main body.

As illustrated in FIGS. 1 and 3, the end portion 18 of the main body 14 is substantially a half-cylindrical shape with a flat surface 31. The main portion 20 and the tail portion 22 of the main body 14 are substantially cylindrical in shape. The tail portion 22 of the main body 14 includes a through hole 38. An element such as a cord (not shown) may be inserted through the hole 38 to allow a user to hang or hold the capping device 10.

Figure 2:
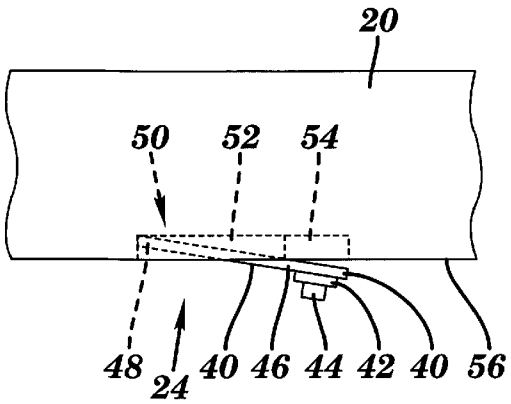
FIG. 2 illustrates a top view of a locking tab attached to the main body.

As illustrated in FIGS. 1, 2, and 3, the actuating apparatus 24 includes a tab 40, a locking body 42, and a button 44. A first end 46 of the tab 40 is attached to the locking body 42. A second end 48 of the tab 40 is attached to the main portion 20 of the main body 14. The tab 40 is made from a flexible resilient material such as metal or plastic. The button 44 is attached to the locking body 42. When the button 44 is depressed, the tab 40 applies continuous outward pressure against the button 44. The main portion 20 of the main body 14 includes a recess 50. The recess 50 includes a substantially rectangular shaped portion 52 intersecting with a round portion 54. When the button 44 is fully depressed, the button 44, the locking body 42, and the tab 40 are received in the recess 50 and are recessed beneath the outer surface 56 of the main portion 20 of the main body 14.

Figure 5:
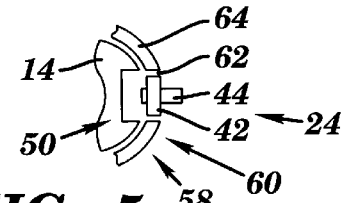
FIG. 5 illustrates a partial cross-sectional view of a locking apparatus taken along line 5—5 of FIG. 4.

FIG. 4 illustrates the capping device 10 including the main body 14 and a housing 58. The main body 14 is inserted into the housing 58 by fully depressing the button 44 and by sliding the main body 14 into the housing 58. Next, the button 44 and the locking body 42 are placed within a first round portion 62 of an opening 60 in the outer wall 64 of the housing 58. The opening 60 in the outer wall 64 includes the round portion 62, a first section 66, a second section 68, a third section 70 (FIG. 9), and a second round portion 72. The first round portion 62 is connected to the first section 66. The second section 66 is connected to the second section 68, and the second section 68 is connected to the third section 70. The second round portion 72 is connected to the third section 70. The button 44 may protrude through the opening 60. The locking body 42 of the actuating apparatus 24 may protrude through the first round portion 62 or the second round portion 72 of the opening 60. FIG. 5 illustrates a partial cross-sectional view of the actuating apparatus 24 taken along line 5—5 (FIG. 4). The button 44 and the locking body 42 protrude through the first round portion 62 of the opening 60. The locking body 42 is fixedly positioned within the round portion 62. This secures the main body 14 with the housing 58, since the locking body 42 is attached to the tab 40 which is in turn attached to the main body 14. In this position, the writing element 26 extends beyond a front edge 74 of the housing 58.

Figure 7:
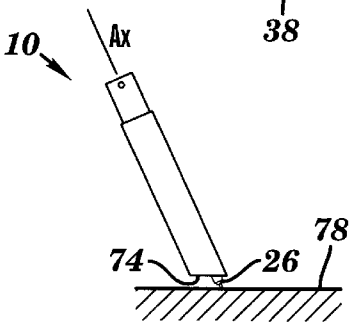
FIG. 7 illustrates a perspective view of the capping device being used for writing on a surface.

As illustrated in FIG. 4, the front edge 74 is slanted at an angle "α" relative to a line 76 which is a line extended beyond the outer surface 56 of the housing 58. The angle "α" is less than 90 degrees and preferably about 60 degrees. FIG. 7 illustrates a perspective view of the capping device 10 being used for writing. The writing element 26 is writing on a surface 78. The slanted front edge 74 allows the longitudinal axis "AX" of the capping device 10 to be tilted relative to the surface 78. This allows a user to view the writing element 26 and prevents the front edge 74 from making contact with the surface 78.

Figure 6:
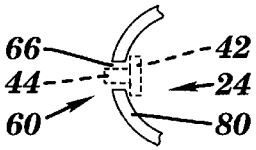
FIG. 6 illustrates a partial cross-sectional view of an opening taken along line 6—6 in FIG. 4.
Figure 9:
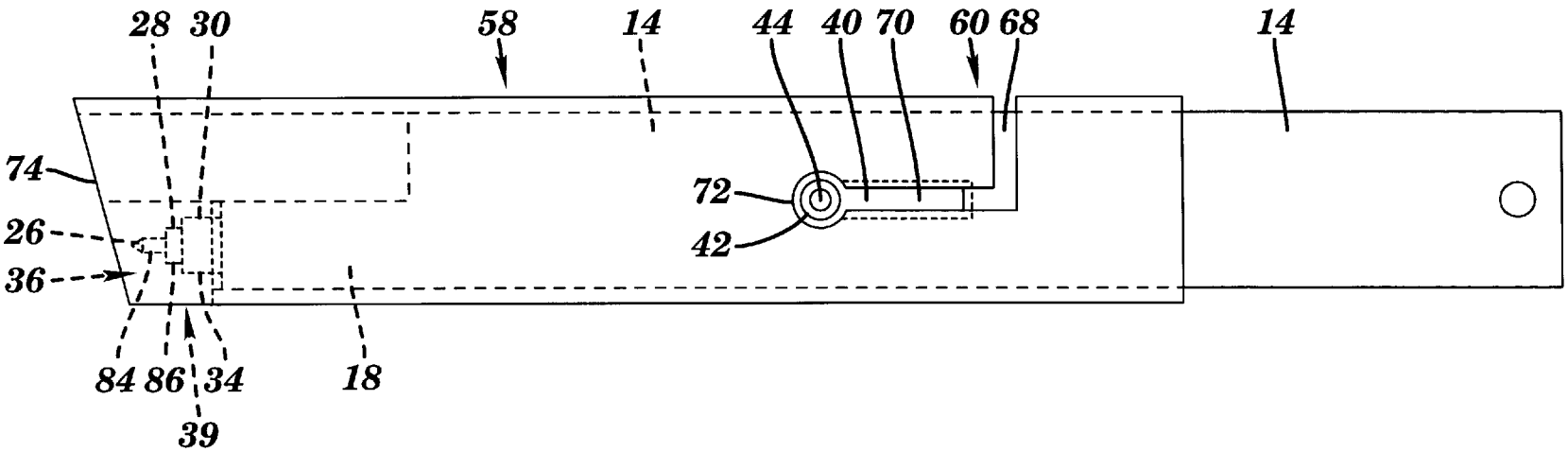
FIG. 9 illustrates a side view of the writing device with the writing element sealed within the cap.

FIG. 6 illustrates a partial cross-sectional view of the first section 66 of the opening 60 taken along a line 6—6 of FIG. 4. The button 44 and the locking body 42 of the actuating apparatus 24 are shown in phantom. In the first section 66, the second section 68, and the third section 70, the locking body 42 slides along an inner surface 80 of the housing 58 while the button 44 protrudes through the opening 60. Thus, a user may grasp the button 44 to move the button 44 along the opening 60 causing the main body 14 to slide within the housing 58 until reaching the first round portion 62 (FIG. 4) or the second round portion 72 (FIG. 9). At these locations, the locking body 42 protrudes through the first round portion 62 or the second round portion 72 thus locking the main body 14 to the housing 58.

FIG. 4 illustrates the cap 36 located in the front portion 82 of the housing 58. The cap 36 includes a recess 39. The recess 39 includes a tip surface 84, a mid surface 86, and the sealing surface 34. The cap 36 is attached within the housing 58 by glueing or is manufactured (e.g., molded) as an integral part of the housing 58.

Figure 8:
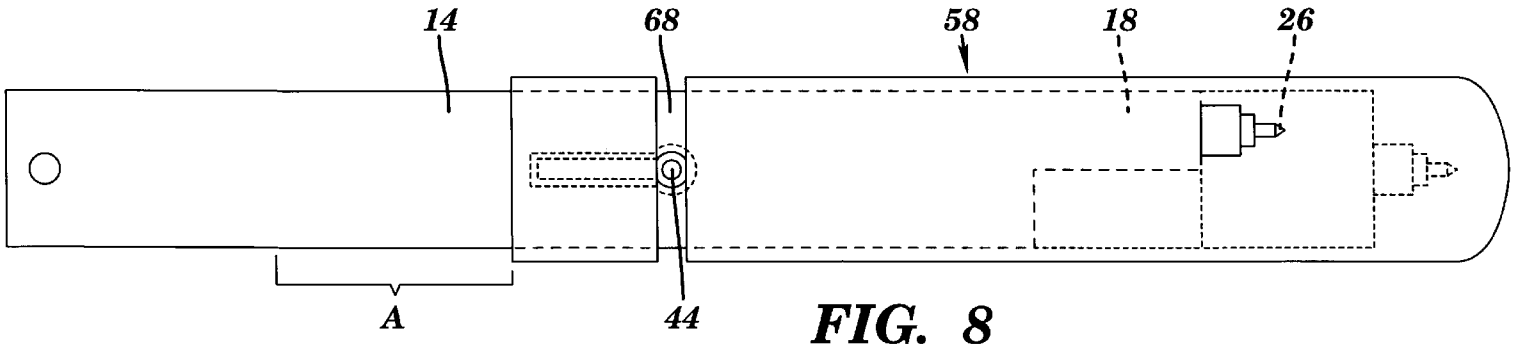
FIG. 8 illustrates a top view of the capping device with the writing tip retracted within the housing.

FIG. 8 illustrates a top view of the capping device 10 with the writing element 26 retracted within the housing 58. To retract the writing element, a user depresses the button 44 and slides the button 44 along the first section 66, and along the second section 68. The movement of the button 44 causes the writing element 26 to be retracted within the housing 58 and then to be rotated about 90 degrees in a clockwise direction when viewed from the writing element 26 end of the housing 58. When the writing element 26 is moved from the writing location illustrated in FIG. 4 to the location shown in FIG. 8, a portion "A" of the main body 14 extends beyond the housing 58. This portion "A" may be colored and/or lettered to warn the user that the writing element 26 is not capped.

FIG. 9 illustrates the writing element 26 sealed into the recess 39 of the cap 36. The writing element 26 is moved into this location by moving the button 44 down along the second section 68 which rotates the main body 14. Next, the button 44 is moved towards the front edge 74 along the third section 70 of the opening 60. Upon reaching the second round portion 72 of the opening 60, the tab 40 applies an outward force on the locking body 42. Next, the locking body 42 of the actuating apparatus extends through the round portion 72 of the opening 70 and locks the main body 14 relative to the housing 58. The main body 14 and the writing element 26 are extended towards the cap 36 until the sealing body 30 forms an air tight seal with the sealing surface 34. Sealing the writing element 26 within the cap 36 protects and prevents the writing element from drying out or leaking. The sealing surface 34 is essentially cylindrical in shape and receives the sealing body 30. Additionally, the sealing surface 34 may include a taper with a smaller diameter portion closest to the front edge 74 end of the housing 58. This places the writing element 26 within the recess 39 of the cap 36. The writing tip 26 is surrounded by the tip surface 84 and the support body 28 is surrounded by the mid surface 86 of the cap 36. The tip surface 84 and the mid surface 86 do not contact the writing tip 26 or the support body 28, respectively.

As illustrated in FIG. 4, when the writing element 26 is in a location for writing, the longitudinal axis of the writing element 26 is offset and does not line up with the longitudinal axis of the recess 39 in the cap 36. The actuating apparatus 24 retracts, rotates, and extends the writing element 26 into the recess 39 in the cap 36. Thus, the actuating apparatus 24 lines up the longitudinal axis of the writing element 26 with the longitudinal axis of the recess 39 in the cap 36 when the writing element 26 is capped.

Additionally, the first section 66, the second section 68, and the third section 70 of the opening 60 may be any suitable shape (e.g., straight, curved, etc.) as long as they provide a continuous path from the desired location of the first round portion 62 and the second round portion 72 of the opening 60.

The actuating apparatus 24 may also be used to return the writing element 26 back to the writing location. The button 44 and the locking body 42 are moved from the second round portion 72 to the first round portion 62 of the opening 60 in the housing 58.

Figure 10:
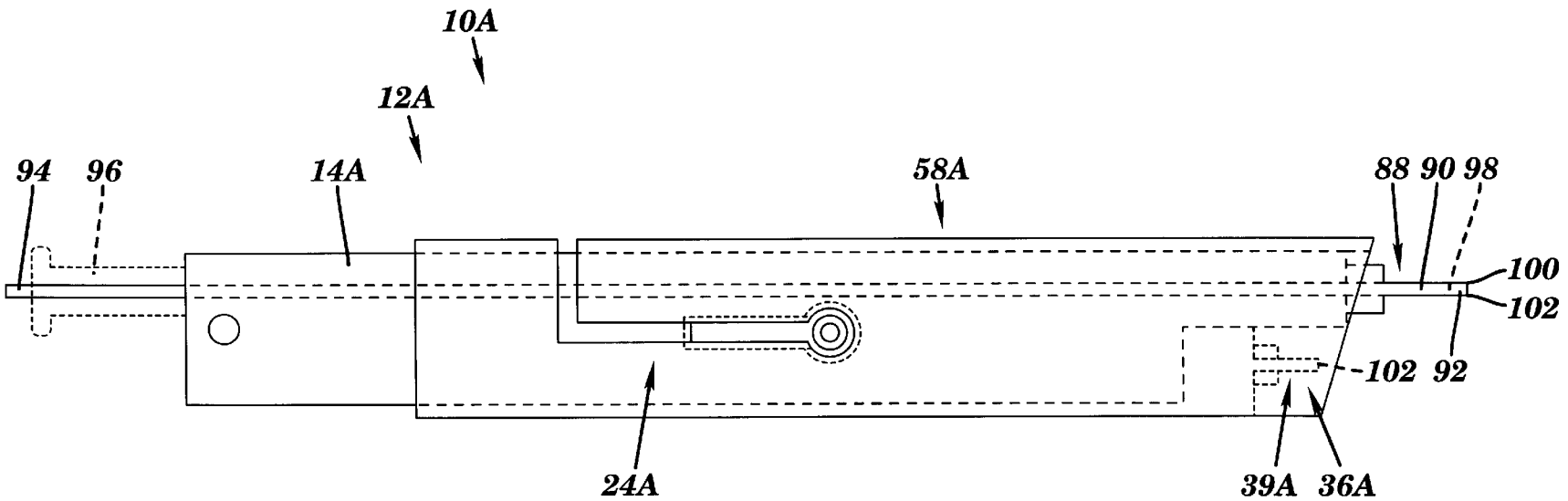
FIG. 10 illustrates a side view of another embodiment of a capping device including an object such as a straw or a needle.

FIG. 10 illustrates another embodiment of a capping device 10A including an object 12A to be capped, and a housing 58A. The object 12A includes a main body 14A. The main body 14A includes an element 88 for dispensing and/or suction. The element 88 may include any suitable apparatus (e.g., a straw, a needle, a spray gun, etc.) for dispensing and/or suction of a material. A first end 102 of the element 88 is used for dispensing and/or suction of a material into or out of the element 88. For example, in FIG. 10 a straw element 90 is illustrated. A first end 92 of the straw element 90 may be placed into a liquid. For drinking, a user may apply suction on a second end 94 of the straw element 90 for drawing the liquid up the straw element 90. FIG. 10 also illustrates another embodiment of the capping device 10A, including a needle apparatus 96 (shown in phantom). The needle apparatus 96 may include a needle 98 such as a hypodermic needle. An end 100 of the needle 98 may be used to inject a liquid material into a patient. An actuating apparatus 24A operates in a similar manner to the actuating apparatus 24 of the capping device 10. The actuating apparatus 24A first retracts the first end 102 of the element 88 into the housing 58A. Next, the actuating apparatus 24A rotates the first end 102 of the element 88 until the first end 102 of the element 88 is in-line with a recess 39A within a cap 36A. Next, the actuating apparatus 24A extends the first end 102 of the element 88 into the recess 39A of the cap 36A. The first end 102 of the element 88 is sealed within the cap 36A. For example, the first end 92 of the straw element 90 may be sealed in the cap 36A to keep the first end 92 clean and protected from damage. In the case of a needle 98, such as a hypodermic needle, whenever the needle 98 is exposed, the end 100 of the needle 98 may be safely sealed and stored in the cap 36A. This prevents the possibility of a person being inadvertently punctured by the end 100 of the needle 98.

Figure 11:
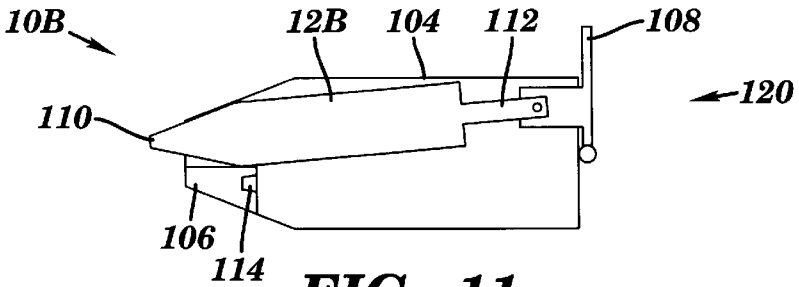
FIG. 11 illustrates a cross-sectional schematic view of another embodiment of a capping device with a first end of an object located outside of a housing.

FIG. 11 illustrates a cross-sectional schematic view of another embodiment of the capping device 10B. The capping device 10B includes an object 12B to be capped, a housing 104, a cap 106, and an actuating apparatus 120. The actuating apparatus 120 includes a control arm 108. The object 12B includes a first end 110. The first end 110 may dispense and/or provide suction of a material. A second end 112 of the object 12B is pivotally attached to the control arm 108. The control arm 108 is pivotally attached to the housing 104. The cap 106 includes a recess 114 to receive and seal the first end 110 of the object 12B. FIG. 11 illustrates the first end 110 of the object 12B in a location extended outside the housing 104. In this location, the first end 110 of the object 12B may dispense and/or provide suction of a material.

Figure 14:
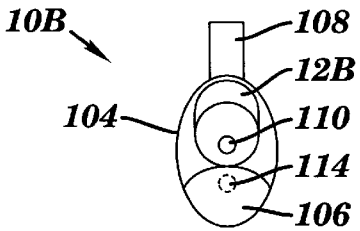
FIG. 14 illustrates a front view of the capping device of FIG. 11.

FIG. 14 illustrates a schematic front view of the capping device 10B including the housing 104, the object 12B, the first end 110 of the object 12B, the cap 106 and the recess 114 in the cap 106. The first end 110 is extended outside the housing 104.

Figure 12:
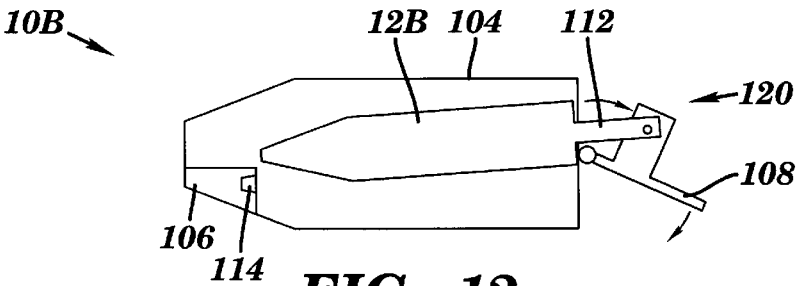
FIG. 12 illustrates a cross-sectional schematic view of the capping device of FIG. 11 with the object in a tilted position within the housing.

FIG. 12 illustrates a cross-sectional schematic view of the capping device 10B with the first end 110 of the object 12B retracted within the housing 104. A user rotates the control arm 108 in a clockwise direction which pulls the second end 112 of the object 12B towards the control arm 108. Additionally, a second end 112 of the object 12B is tilted in a downward direction.

Figure 13:
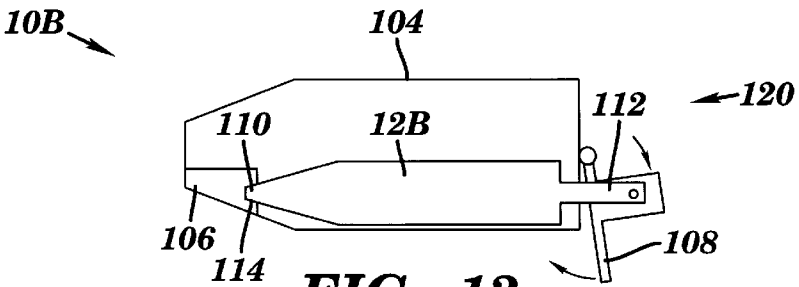
FIG. 13 illustrates a cross-sectional schematic view of the capping device of FIG. 11 with the first end of the object extended and sealed in a cap.

Next, a user further rotates the control arm 108 in a clockwise direction to extend the first end 110 of the object 12B into the recess 114 of the cap 106 as illustrated in FIG. 13. The clockwise rotation of the control arm 108 causes the object 12B to be tilted in a clockwise direction. Additionally, the clockwise rotation of the control arm 108 causes the first end 110 of the object 12B to be extended into the recess 114 of the cap 106.

As illustrated in FIG. 11, when the first end 110 of the object 12B is in a location for dispensing and/or suction, the longitudinal axis of the first end 110 of the object 12B is offset and does not line up with the longitudinal axis of the recess 114 in the cap 106. The control arm 108 of the actuating apparatus 120, retracts, tilts, and extends the first end 110 of the object 12B into the recess 114 in the cap 106. Thus, the actuating apparatus 120 lines up the longitudinal axis of the first end 110 of the object 12B with the longitudinal axis of the recess 114 in the cap 106 when the first end 110 of the object 12B is capped.

The foregoing description of the present invention has been presented for purposes of illustration and description. It is not intended to be exhaustive or to limit the invention to the precise form disclosed, and many modifications and variations are possible in light of the above teaching. For example, the object 12 can be any suitable dispensing and/or suction device (e.g., needle, lipstick, spray gun, fountain pen, felt tip pen, dry marker , etc.). Such modifications and variations that may be apparent to a person skilled in the art are intended to be included within the scope of this invention as defined by the accompanying claims.

I claim:

1. A capping device comprising:

a housing;

a cap attached within the housing for sealing an end of an object;

an actuating apparatus attached to the object for moving the end of the object from a first location outside the housing to a second location within the cap, wherein the cap is offset from the first location, and for moving the end of the object from the second location within the cap back to the first location outside the housing, and wherein a front edge of the housing is slanted at an angle less than 90 decrees as measured between the front edge and an outer surface of the housing.

2. The capping device of claim 1, wherein the actuating apparatus includes sliding and rotation of the end of the object from the first location to the second location.

3. The capping device of claim 1, wherein the actuating apparatus includes sliding and tilting of the end of the object from the first location to the second location.

4. The capping device of claim 3, wherein the actuating apparatus further includes a control arm with a first end pivotally attached to the housing and a second end pivotally attached to the end of the object.

5. The capping device of claim 1, wherein the end of the object is a writing element.

6. The capping device of claim 5, wherein the writing element includes a felt tip.

7. The capping device of claim 5, wherein the writing element includes a ball point tip.

8. The capping device of claim 5, wherein the writing element is a dry marking tip.

9. The capping device of claim 1, wherein the end of the object is a straw for drinking.

10. The capping device of claim 1, wherein the end of the object is a needle.

11. The capping device of claim 1, wherein a front edge of the housing is slanted at an angle less than 90 degrees as measured between the front edge and an outer surface of the housing.

12. The capping device of claim 1, wherein the cap further includes an air tight seal around the end of the object.

13. The capping device of claim 1, wherein the actuating apparatus further includes an opening in the housing including sections connecting a first locking location for positioning the end of the object in the first location outside the housing and a second locking location for positioning the end of the object in the second location within the cap.

14. The capping device of claim 13, wherein the actuating apparatus further includes a button for moving the object along the opening in the housing.

15. The capping device of claim 13, wherein the actuating apparatus further includes a locking body for selectively securing the object in the first locking location and in the second locking location.

16. A method for capping comprising:

providing a cap within a housing, wherein a front edge of the housing is slanted at an angle less than 90 degrees as measured between the front edge and an outer surface of the housing;

retracting an end of an object from a first location outside the housing to a second location within the housing using an actuating apparatus attached to the object;

rotating the end of the object into a position for capping; and extending the end of the object into the cap for sealing the end of the object.

17. The method of capping of claim 16, wherein the end of the object is a writing element.

18. The method of capping of claim 16, wherein the end of the object is a straw for drinking.

19. The method of capping of claim 16, wherein the end of the object is a needle.

20. The method of capping of claim 16, wherein the end of the object is lipstick.

* * * * *